United States Patent [19]

Simjian

[11] 3,960,144

[45] June 1, 1976

[54] EXERCISE AND MASSAGING APPARATUS

[76] Inventor: Luther G. Simjian, 7 Laurel Lane, Greenwich, Conn. 06830

[22] Filed: July 10, 1975

[21] Appl. No.: 594,640

[52] U.S. Cl. ..... 128/58; 128/63

[51] Int. Cl.[2] ..... A61H 11/00; A61H 7/00

[58] Field of Search ..... 128/58, 63, 24.2, 44–53, 128/56

[56] References Cited

UNITED STATES PATENTS

| | | | |
|---|---|---|---|
| 857,761 | 6/1907 | Schmidt | 128/56 UX |
| 3,861,382 | 1/1975 | Simjian | 128/58 |

*Primary Examiner*—Lawrence W. Trapp

[57] ABSTRACT

An exercise and massaging apparatus includes a bicycle type structure with pedal means and a massaging belt fitting around the torso of the person using the apparatus. Responsive to operation of the pedal means, the massaging belt undergoes a side-to-side oscillating motion. The motion of the belt is provided by an arm to which the belt is secured and which undergoes reciprocating rotational motion about a substantially horizontal axis responsive to rotational motion imparted to the pedal means. The apparatus includes clutch means for selectively coupling or uncoupling the motion of the belt from the pedal means.

25 Claims, 12 Drawing Figures

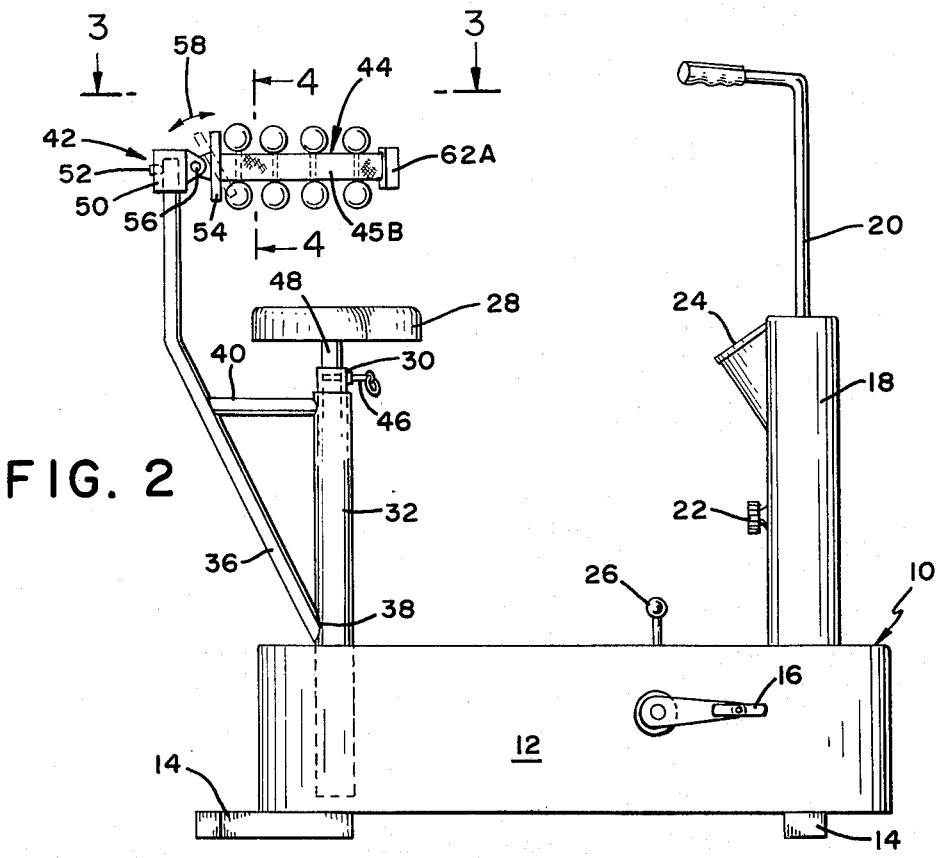
FIG. 2
FIG. 4
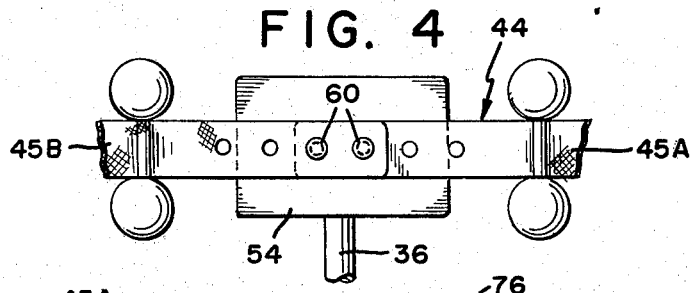
FIG. 3
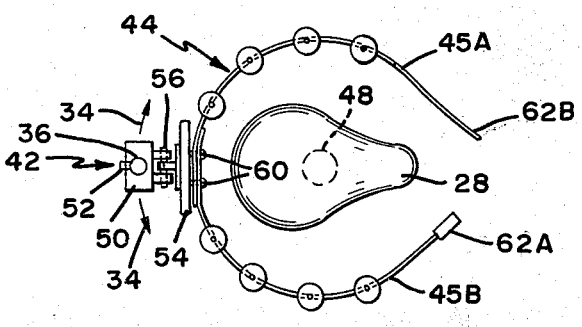
FIG. 5
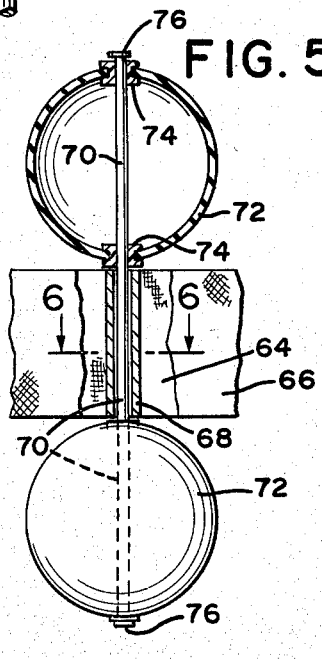
FIG. 6
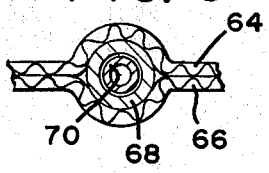
FIG. 7
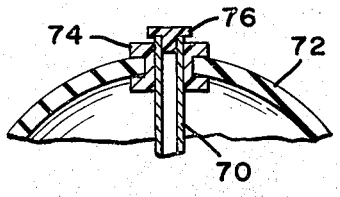

EXERCISE AND MASSAGING APPARATUS

BRIEF SUMMARY OF THE INVENTION

This invention refers to an exercise apparatus combined with massaging means as described in my prior U.S. Pat. Nos. 3,727,608; 3,777,745; 3,861,382; 3,899,115 and pending applications Ser. No. 508,511 and 523,565.

In the prior patents and applications I have disclosed an exercise apparatus, typically, a stationary bicycle which when operated by a person also imparts motion to a massaging means, such as a belt, encircling the torso of the person undergoing the exercise. The belt is provided with resilient flexible massaging elements which reciprocatingly roll over the engaged torso portion at a speed determined by the speed imparted to the pedals of the bicycle. Thus, the massaging effect is directly related to the muscular effort of the person.

The present invention discloses an alternative construction for an exercise apparatus of the type indicated, but is characterized by simplified and improved performance. Particularly, the portion of the exercise device relating to the transmission of the motion to the massaging belt is simplified without detracting from the therapeutic value derived from the exercise apparatus. Other constructional improvements incorporated in the present apparatus will be more clearly apparent by reference to the following description when taken in conjunction with the accompanying drawings.

BRIEF DESCRIPTION OF THE SEVERAL VIEWS OF THE DRAWINGS

FIG. 2 is a side elevational view of the present apparatus;

FIG. 3 is a top plan view of the apparatus along line 3-3 in FIG. 2;

FIG. 4 is an elevational view along line 4—4 in FIG. 2;

FIG. 5 is an elevational view, partly in section, of a portion of the massaging belt;

FIG. 6 is a sectional view along line 6—6 in FIG. 5;

FIG. 7 is a sectional view of a detail of the massaging belt construction;

DETAILED DESCRIPTION

Figure 1:
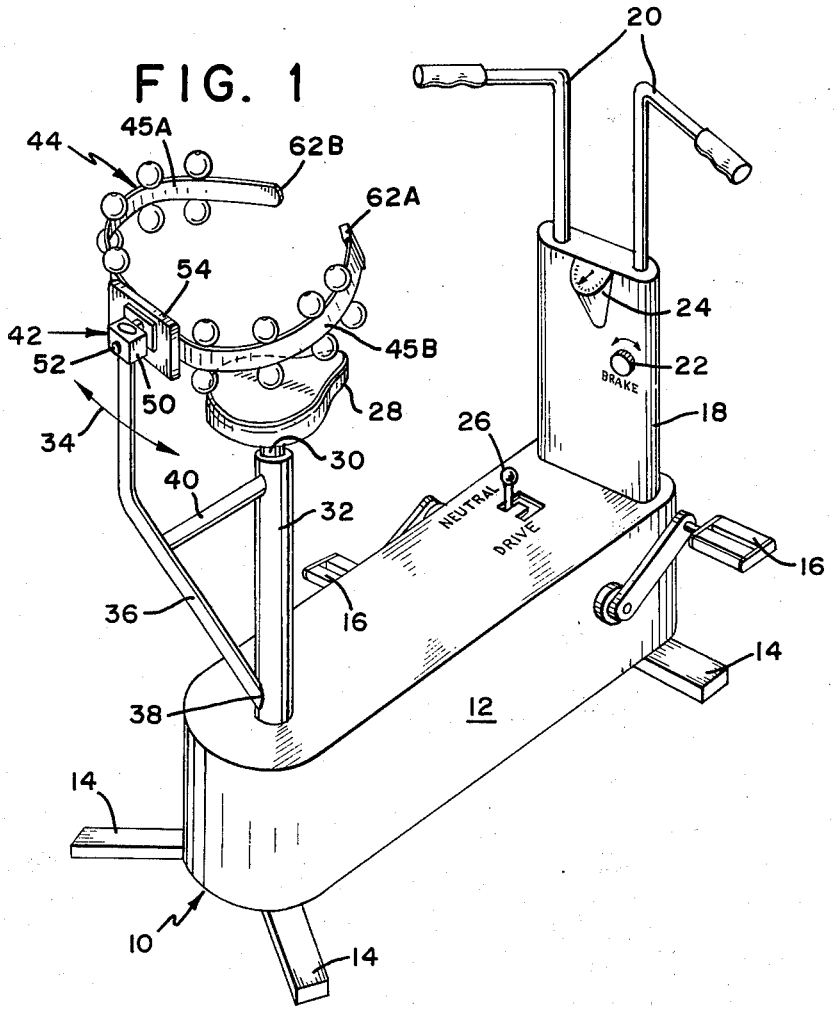
FIG. 1 is a perspective view showing the top, rear and side of the present apparatus.

Referring now to the figures and FIGS. 1 and 2 in particular, numeral 10 identifies generally a stationary support covered by a suitable cover, such as a sheet metal enclosure 12. A set of horizontally disposed cross plates 14 serve as feet for the support 10. The support 10 supports pedal means 16, a console 18 which, in turn, is provided with a set of stationary handle bars 20, a brake control means 22 and a tachometer 24. A clutch shift lever grip 26 protrudes from the sheet metal enclosure 12. Toward the rear of the apparatus there is located a seat 28 elevated from the support 10 by means of a stationary post 30. The post 30 is surrounded by a tubing 32 which, responsive to the rotation of the pedal means 16, is caused to undergo reciprocating rotational motion about an axis through the center of post 30. The tubing 32 supports a rearwardly extending arm 36 which at its lower end 38 is welded to the tubing 32 and which, furthermore, is fixedly held to the tubing 32 by a cross brace 40. The upper portion of the arm 36 supports a mounting means 42 for fastening thereto a massaging means, such as a belt 44.

It will be apparent that a person sitting on the seat 28, supporting himself at the handle bars 20, having secured the belt 44 about his torso, and operating the pedal means 16 receives a massaging action as the arm 36 secured to the tubing 32 undergoes reciprocating rotational motion, indicated by the duble headed arrow 34, as the result of the reciprocating rotational motion imparted to the tubing 32 stated heretofore.

As more clearly seen in FIG. 2, the seat 28 is adjustable in height relative to the belt mounting means 42 by means of a pin 46 adapted to fit through suitably spaced holes in the post 30 and the seat socket 48.

The fastening of the belt 44 to the mounting means 42 is shown in detail with reference to FIGS. 2, 3 and 4. The mounting means 42 includes a collar 50 fitted over the upper end of the arm 36 and secured by a screw 52. Two spaced parallel ears extend forwardly from the collar 50. A plate 54 has a single ear extending rearwardly into the space between the two ears of collar 50 and a pivot 56 extends horizontally through the three aligned ears to provide for pivotal motion of the plate 54. Since the massaging belt 44 is fastened to the plate 54 the massaging belt when secured about the person on the seat 28 may be disposed in a plane deviating from the horizontal plane as seen, for instance, by the dashed lines of plate 54 in FIG. 2 and the arrow 58 indicating the pivotal motion possible by the plate 54. The belt 44 comprises two halves 45A and 45B which may be fastened to the plate 54 in overlapping relationship by snap fastening means 60 and corresponding holes in the belt halves, see FIG. 4. As seen clearly in FIG. 4, additional holes are provided in the respective belt halves in order to adjust the girth of the belt 44. Additionally, each belt half is provided at the distance end with standard buckle closure means 62A and 62B to close the belt in front of the wearer.

The massaging belt is constructed from a pair of juxtaposed fabric bands 64 and 66, such as canvas, see FIG. 6. At spaced intervals a tubing 68 is inserted between the bands, see also FIG. 5. A further and longer tubing 70 is disposed inside the tubing 68 and adapted to rotate with respect to the outer tubing 68. The tubing 70 extends on each side from the tubing 68 and the respective tubings 70 are provided at either side with a resilient massaging element 72 of spherical or other suitable shape made of rubber, for instance. The massaging elements 72 are retained upon the respective tubing 70 by suitable grommets 74, see FIGS. 5 and 7. A cap or plug 76 closes the opening of the tubing 70 at either end.

Figure 8:
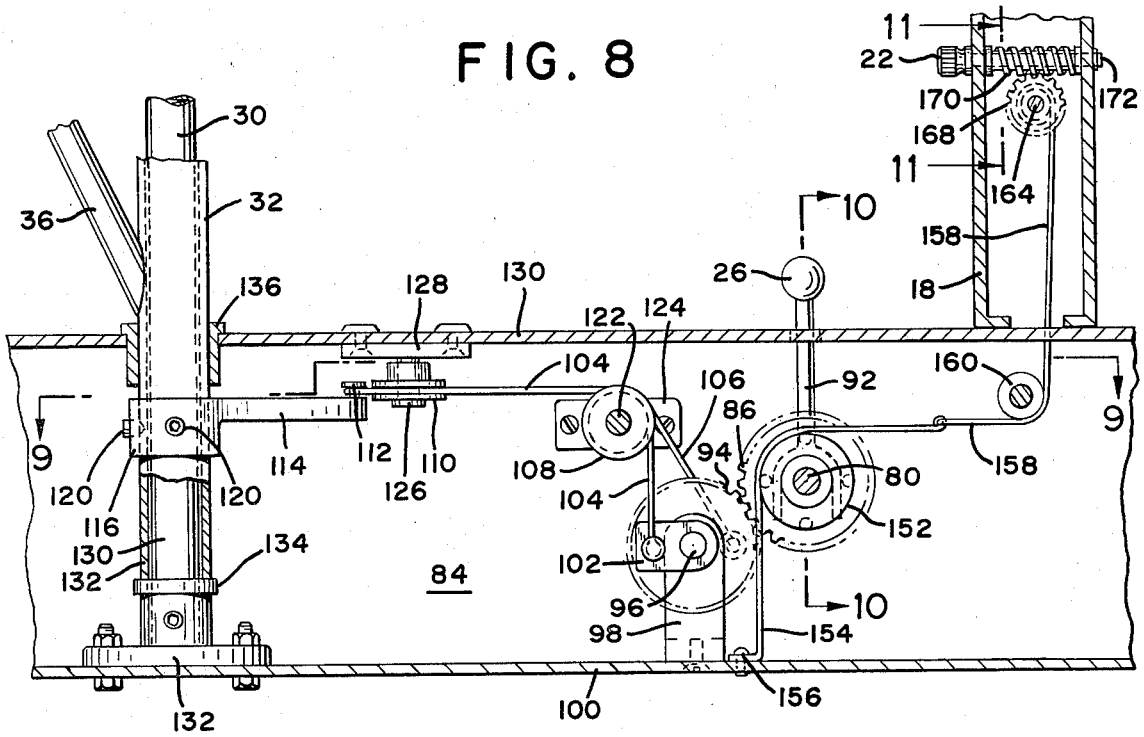
FIG. 8 is a side elevational view, partly in section, of the exercise apparatus with cover removed taken along line 8—8 in FIG. 9.
Figure 9:
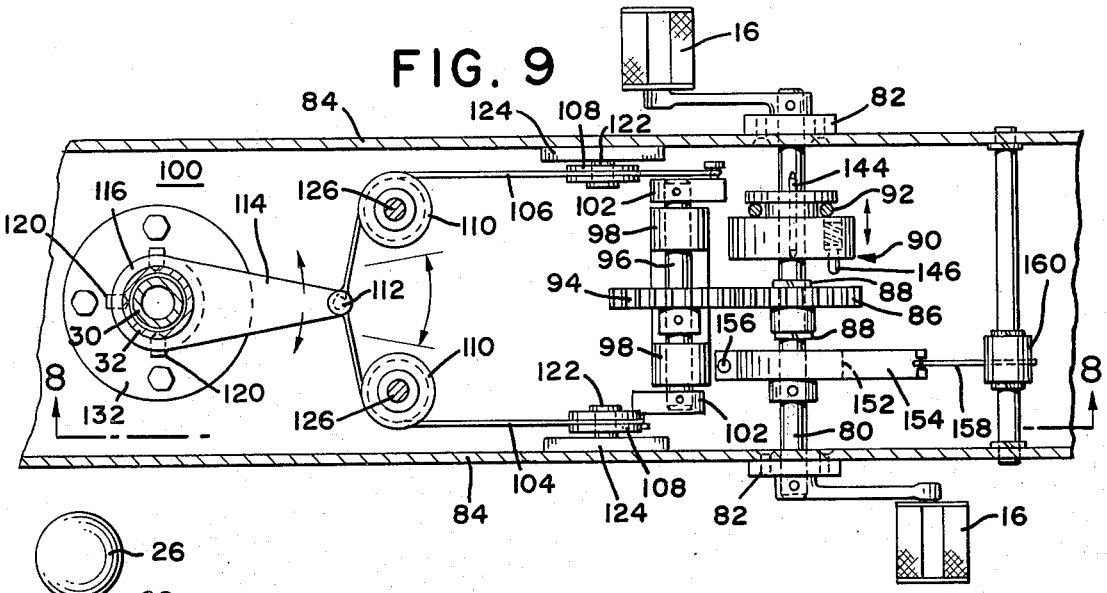
FIG. 9 is a sectional view along line 9—9 in FIG. 8.

The arrangement of coupling the motion of the pedal means 16 to the tubing 32 and converting the rotational motion of the pedal means to reciprocating rotational motion of the tubing 32 and arm 36 will be described with reference to FIGS. 8 and 9. Referring to these figures, the pedal means 16 include a pedal shaft 80 supported for rotation in a set of journals 82 fastened to respective side plates 84. The pedal shaft 80 has mounted thereupon for loose rotation relative to the shaft 80 a spur gear 86 which is positioned axially on the shaft 80 by snap rings 88, one ring on each side of the gear 86. Each snap ring fits into a respective groove on the shaft. A coupling or clutch means 90, to be described in detail later, is also mounted upon the pedal shaft 80. When the clutch 90 is disposed in the position shown in FIG. 9, the clutch is disengaged from the gear 86 and the gear 86 is standing still although the pedal shaft 80 may be rotating. When the clutch 90 is moved toward the gear 86 as effected by the clutch lever 92, the gear 86 is locked to the rotation of the pedal shaft 80. Rotation of the gear 86 is transferred then to the spur gear 94 which is pinned to a shaft 96 journalled in a set of bearings 98 fastened to a base plate 100. The respective ends of the shaft 96 have secured thereupon a respective crank arm 102 using suitable tapered pins. The crank arms are mounted pointing oppositely. At points 180 degrees opposite with respect to one another, each crank arm 102 has secured thereto at its side surface a band 104 or 106 respectively. Each of the bands is fed over an associated fixed center pulley 108 and 110 until both bands meet and are attached to a pin at a common location 112 of a bracket 114. The bracket 114 is welded to a collar 116 which surrounds the tubing 32 and which is mechanically coupled to the tubing 32 by means of a set of radially disposed set screws 120 so as to transmit motion from the collar 116 to the tubing 32.

Therefore, rotation imparted to the gear 94 causes rotation of the shaft 96 and of both crank arms 102. The ends of bands 104 and 106 are fastened to the arms at diametrically opposite locations to provide a push-pull action, such motion manifesting itself as a reciprocating rotational motion at location 112 which rotates about a substantially vertical axis through the center of tubing 32. This motion is applied to the collar 116 and transmitted to tubing 32 which, in turn, causes concomitant motion of the arm 36 to which the massaging belt 44 is fastened. Generally, the mechanism is designed to provide a rotational excursion not exceeding an arc of 180°.

The pulleys 108 are secured upon respective stub shafts 122 extending from respective plates 124 supported by the respective side plates 84. Similarly, the pulleys 110 are secured upon respective stub shafts 126 extending from respective plates 128 secured to top plate 130.

The rotatable tubing 32 is supported upon a flange 132 screw fastened to the base plate 100 and a thrust bearing 134 located between the upper end of the flange 132 and the lower end of the tubing 32. A sleeve bearing 136 inserted into a suitable aperture of the top plate 130 journals the tubing 32 along its length.

Figure 10:
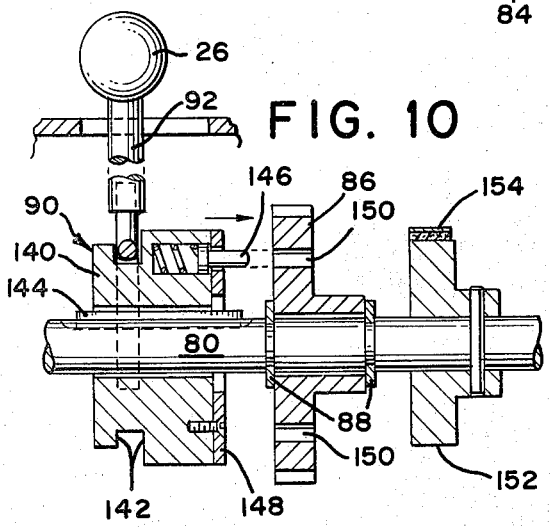
FIG. 10 is a view of a clutch means used, viewed along section line 10—10 in FIG. 8.

The clutch means 90 permits the massaging belt drive to be either disconnected from the pedal shaft so that the present exercise apparatus can be used in the manner of a conventional bicycle exercise device, or alternatively as a combined exercise and massaging apparatus. This selection is accomplished by moving the lever 92 between two predetermined positions. The clutch means 90 comprises a drum 140, see FIG. 10, having a groove 142 which is engaged by the bifurcated lower end of the shift lever 92. The drum 140 is mounted for sliding axial motion along pedal shaft 80 on a key 144. The drum has along its side an aperture for receiving therein a spring biased pin 146 which is prevented from falling out from the aperture by a suitable side plate 148 screw fastened to the drum 140 by a set of countersunk screws. The gear 86 on pedal shaft 80 is provided with a set of axially directed apertures 150 for receiving therein the pin 146. As the clutch lever 92 is moved toward the right, see FIG. 10, the drum 140 is moved axially along the key 144 toward the gear 86 and as a certain rotational position is reached, the pin 146 will engage one of the apertures 150 of the gear 86. When this occurs, the rotation of the pedal shaft 80 is rigidly coupled via the drum 140 to the gear 86 and from there to the gear 94, the shaft 96, crank arms 102, etc. to effect the motion of the arm 36 as described heretofore.

Figure 11:
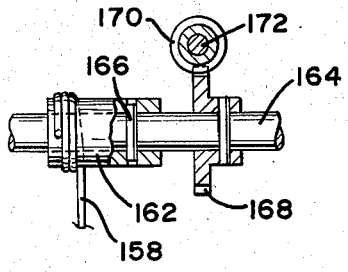
FIG. 11 is a view along section line 11—11 in FIG. 8 showing a detail of the brake mechanism.

The present exercise apparatus includes, moreover, a brake mechanism to vary the muscular effort required for rotating the pedal shaft. The pedal shaft 80 has affixed thereupon a brake drum 152 which is pinned to the shaft 80, see FIGS. 8, 9, 10 and 11. A brake lining faced band 154 is fastened with one end 156 to the base plate 100 and engages a portion of the periphery of the drum 152. The other end of the band 154 is joined to a wire or rope 158 which is fed over a pulley 160 and wound upon and fastened to a drum 162. The drum 162 is secured to a shaft 164 by a pin 166, see FIG. 11. The shaft 164 has affixed thereupon also a worm gear 168 which meshes with a worm 170 affixed to shaft 172. The knob 22 shown in FIGS. 1 and 8 is attached to shaft 172 and serves for adjustably controlling the friction between the brake lining of the band 154 and the brake drum 152 so as to control the degree of effort required for operating the exercise apparatus.

The speed indication of the tachometer 24 can be provided either by a mechanical connection using a flexible tachometer cable coupled to the pedal shaft and a standard centrifugal type tachometer, or alternatively, a permanent magnet generator coupled to the pedal shaft can be used to produce a voltage signal proportional to speed, which signal is fed to a voltmeter whose scale is suitably calibrated in units of speed. Both arrangements are well known to those skilled in the art and need not to be explained further.

Figure 12:
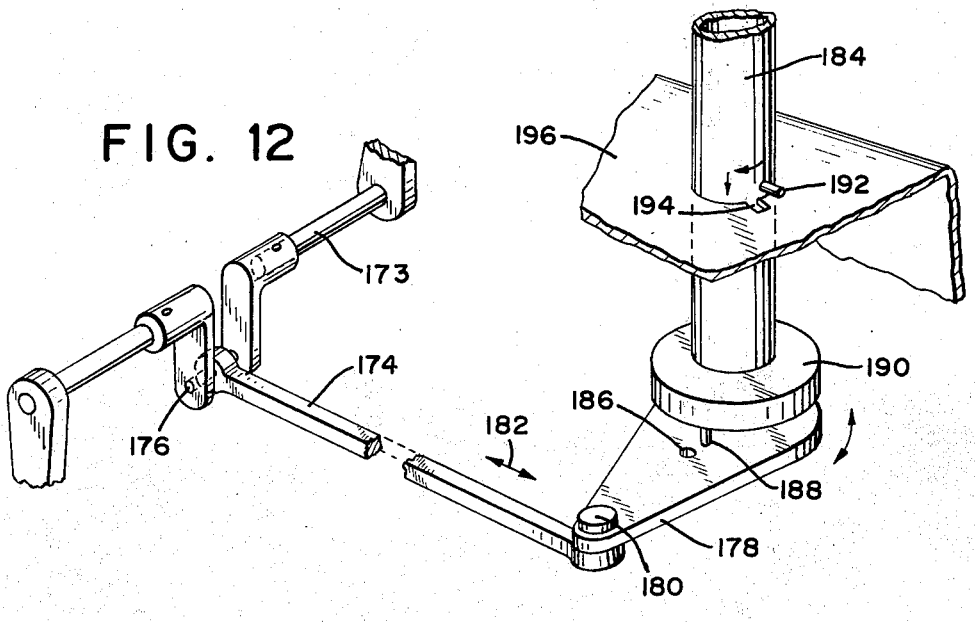
FIG. 12 is a perspective view showing an alternative embodiment of the drive means for converting rotating motion to reciprocating motion and means for coupling or uncoupling the motion between the pedal shaft and the massaging belt.

FIG. 12 depicts a modified embodiment useful for the present apparatus. The pedal shaft is constructed in the form of a crank shaft 173. A rod 174 is fastened to the crank shaft 173 by a pin 176 at one end and is secured with its other end to a horizontal bracket 178 using a pivot pin 180. As the crank shaft 173 rotates, the rod 174 undergoes reciprocating translating motion in the direction of the double headed arrow 182, thereby causing the bracket 178 to undergo reciprocating rotational motion about a vertical axis passing through the center of the vertical tubing 184 and intersecting the support 10. The tubing 184 corresponds in its function to the tubing 32 described hereinabove, see FIG. 1. The tubing 184 is combination with the bracket 178 are provided with means for disengaging, if desired, the motion of the tubing 184 from that of the pedal shaft 173. To this end, the bracket 178 is constructed with an aperture 186 adapted to mate with a pin 188 affixed to the underside of a ring 190 forming a part of the tubing 184. Along the side of the tubing 184 there is provided a pin 192 adapted to fit through a slot 194 of a stationary bracket 196. As illustrated in FIG. 12, the motion of the pedal shaft and bracket 178 is not transmitted to the tubing 184. To provide coupling, the tubing 184 is rotated clockwise until the pin 192 is disposed above the slot 194. Then the pedal shaft 173 is rotated slowly, causing the bracket 178 to move and when the pin 188 is in registry with the aperture 186, the pin 188 drops into the aperture 186 and the pin 192 falls into the slot 194. This condition establishes coupling between the motion of the pedal shaft and the arm 36 to which the massaging belt is attached. To uncouple the belt motion, the pedal shaft is rotated until the pin 192 is aligned with the slot 194, then the tubing 184 is lifted until the pin 192 is above the stationary bracket 196 and slightly rotated for resting the pin 192 on the solid portion of the bracket 196.

It will be apparent that the pin and slot coupling arrangement described in connection with FIG. 12 serves the same function as the clutch means 90 shown above. Other and similar means, such as a friction clutch, a magnetic clutch or a magnetic powder clutch are, of course, usable also for selectively coupling or uncoupling the motion of the pedal shaft from the arm 36 and the massaging belt fastened thereto.

Instead of the crank arms 102 or the crank shaft 173, an eccentric cam mechanism can be used in a similar manner for converting the rotational motion of the pedal shaft to reciprocating motion. Also the arm 36 preferably includes a telescopic joint for adjusting the height of the belt mounting means 42 relative a to the seat 28. The tubing 32 may be constructed from axially spaced members, a mesh, or similar structural elements.

In a further modification a motor is provided and coupled to the pedal shaft for reducing or, if necessary, eliminating the effort required by the person in operating the present exercise apparatus. This latter embodiment will be found advantageous in the rehabilitation of cardiac patients.

While there has been described and illustrated an improved exercise and massaging apparatus together with certain modifications, it will be apparent to those skilled in the art that various further changes and modifications may be made therein without deviating from the broad principle of this invention which shall be limited only by the scope of the appended claims.

What is claimed is:

1. An exercise and massaging apparatus comprising in combination:

a stationary support;

pedal means including a rotatable pedal shaft mounted to said support;

a seat supported by said support;

an arm upstanding from said support and mounted for reciprocating rotational motion about a substantially vertical axis;

mounting means disposed at the upper portion of said arm for fastening thereto massaging massagng belt adapted to be secured about the torso of a person sitting on said seat, and drive means coupled between said pedal shaft and said arm for causing responsive to rotation of said pedal shaft said arm to undergo reciprocating rotational motion and a belt fastened to said mounting means and secured about the torso of a person to undergo a cyclic side-to-side oscillating motion.

2. An exercise and massaging apparatus as set forth in claim 1, said drive means including means for converting rotational motion to reciprocating motion.

3. An exercise and massaging apparatus as set forth in claim 1, said drive means including crank arm means.

4. An exercise and massaging apparatus as set forth in claim 3, said crank arm means being coupled to said pedal shaft for rotation therewith.

5. An exercise and massaging apparatus as set forth in claim 1, said axis intersecting said support.

6. An exercise and massaging apparatus as set forth in claim 1, said mounting means adapted for removably fastening the massaging belt.

7. An exercise and massaging apparatus as set forth in claim 1, said mounting means including pivot means for accommodating said massaging belt in a plane deviating from the horizontal plane.

8. An exercise and massaging apparatus as set forth in claim 7, said mounting means including a plate disposed for pivotal motion about a substantially horizontal axis.

9. An exercise and massaging apparatus as set forth in claim 1, and said drive means including means for selectively disconnecting the rotation of said pedal shaft from said arm.

10. An exercise and massaging apparatus as set forth in claim 9, said means for selectively disconnecting comprising clutch means.

11. An exercise and massaging apparatus as set forth in claim 10, said clutch means being coupled to a lever shiftable between two positions providing for the clutch to be engaged or disengaged respectively.

12. An exercise and massaging apparatus as set forth in claim 1, and friction brake means disposed for adjustably controlling the effort required for rotating said pedal shaft.

13. An exercise and massaging apparatus as set forth in claim 12, said friction brake means including a brake drum coupled to said pedal shaft and friction means disposed for forcibly engaging said drum.

14. An exercise and massaging apparatus as set forth in claim 13, said friction means being mounted for engaging the periphery of said drum.

15. An exercise and massaging apparatus as set forth in claim 1, said seat being secured to a post upstanding from said support;

a tubing surrounding said post and rotatable about said post;

means rigidly mounting said arm to said tubing, and said drive means being coupled between said pedal shaft and said tubing whereby to impart said reciprocating motion to said arm.

16. An exercise and massaging apparatus as set forth in claim 15, said drive means causing said arm to undergo reciprocating rotational motion about an arc of less than 180°.

17. An exercise and massaging apparatus as set forth in claim 1, and means disposed for adjusting the height of said seat relative to said mounting means disposed on said arm.

18. An exercise and massaging apparatus comprising in combination:

a stationary support;

pedal means including a rotatable pedal shaft mounted for rotation to said support;

a seat supported by said support;

an arm upstanding from said support mounted for reciprocating rotational motion about a substantially vertical axis;

mounting means disposed at the upper portion of said arm for fastening thereto a massaging belt adapted to be secured about the torso of a person sitting on said seat;

drive means coupled between said pedal shaft and said arm for causing responsive to rotation of said pedal shaft said arm to undergo said reciprocating rotational motion, and coupling means which include pin and aperture means interposed in said drive means for selectively coupling or uncoupling the motion between said pedal shaft and said arm.

19. An exercise and massaging apparatus as set forth in claim 18, said coupling means including a tubing to which said arm is secured, said pin and aperture means operatively associated with said tubing.

20. An exercise and massaging apparatus as set forth in claim 19, said seat being supported by a post upstanding from said stationary support, and said tubing surrounding said post.

21. An exercise and massaging apparatus as set forth in claim 19, said tubing being liftable relative to said support for uncoupling said motion by disengaging said pin from said aperture means.

22. An exercise and massaging apparatus as set forth in claim 1, and including a massaging belt comprising two halves removably fastened to said mounting means; said halves including means for being fastened to another one in adjustable overlapping relation for adjusting the girth of the belt.

23. An exercise and massaging apparatus as set forth in claim 22, each of said halves comprising fabric material and means supported by said fabric material for holding massaging elements.

24. An exercise and massaging apparatus as set forth in claim 23, said massaging elements comprising spherical members.

25. An exercise and massaging apparatus as set forth in claim 24, said spherical members being retained on tubular means extending from said fabric material.

* * * * *